US010371441B2

(12) United States Patent
Van Leeuwen et al.

(10) Patent No.: US 10,371,441 B2
(45) Date of Patent: Aug. 6, 2019

(54) HYDROCARBON CONDENSATE STABILIZER AND A METHOD FOR PRODUCING A STABILIZED HYDROCARBON CONDENSATE STREAM

(71) Applicant: SHELL OIL COMPANY, Houston, TX (US)

(72) Inventors: Lars Hendrik Van Leeuwen, Rijswijk (NL); Micha Hartenhof, Seria (BN); Divya Jain, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 98 days.

(21) Appl. No.: 15/326,960

(22) PCT Filed: Jul. 9, 2015

(86) PCT No.: PCT/EP2015/065692
§ 371 (c)(1),
(2) Date: Jan. 17, 2017

(87) PCT Pub. No.: WO2016/012250
PCT Pub. Date: Jan. 28, 2016

(65) Prior Publication Data

US 2017/0191748 A1 Jul. 6, 2017

(30) Foreign Application Priority Data

Jul. 24, 2014 (EP) ..... 14178262

(51) Int. Cl.
*F25J 3/02* (2006.01)
*F25J 1/00* (2006.01)
(Continued)

(52) U.S. Cl.
CPC ..... *F25J 1/0022* (2013.01); *C10G 5/06* (2013.01); *C10G 7/02* (2013.01); *C10L 1/04* (2013.01);
(Continued)

(58) Field of Classification Search
CPC ..... F25J 3/0209; F25J 3/0233; F25J 3/0238; F25J 3/0242; F25J 2200/72;
(Continued)

(56) References Cited

U.S. PATENT DOCUMENTS 2,066,100 A 10/1934 Dimmig
4,404,008 A 9/1983 Rentler et al.
(Continued)

FOREIGN PATENT DOCUMENTS

AU 4349385 12/1985
CA 2858155 6/2013

OTHER PUBLICATIONS

Pek et al., Large Capacity LNG Plant Development, Paper PS5-3, J.J.B., presented at 14th International Conference & Exhibition on Liquefied Natural Gas (Doha, Qatar), Mar. 21, 2004.
(Continued)

*Primary Examiner* — Brian M King

(57) ABSTRACT

A mixed phase pressurized unstabilized hydrocarbon stream is fed into a stabilizer column at a feed pressure. A liquid phase of stabilized hydrocarbon condensate is discharged from a bottom end of the stabilizer column, while a vapor phase of volatile components from the pressurized unstabilized hydrocarbon condensate stream is discharged from a top end of the stabilizer column. The vapor phase being discharged from the top end of the stabilizer column is compressed and subsequently passed through an ambient heat exchanger wherein partial condensation takes place. The resulting partially condensed overhead stream is sepa-
(Continued)

Figure 1:
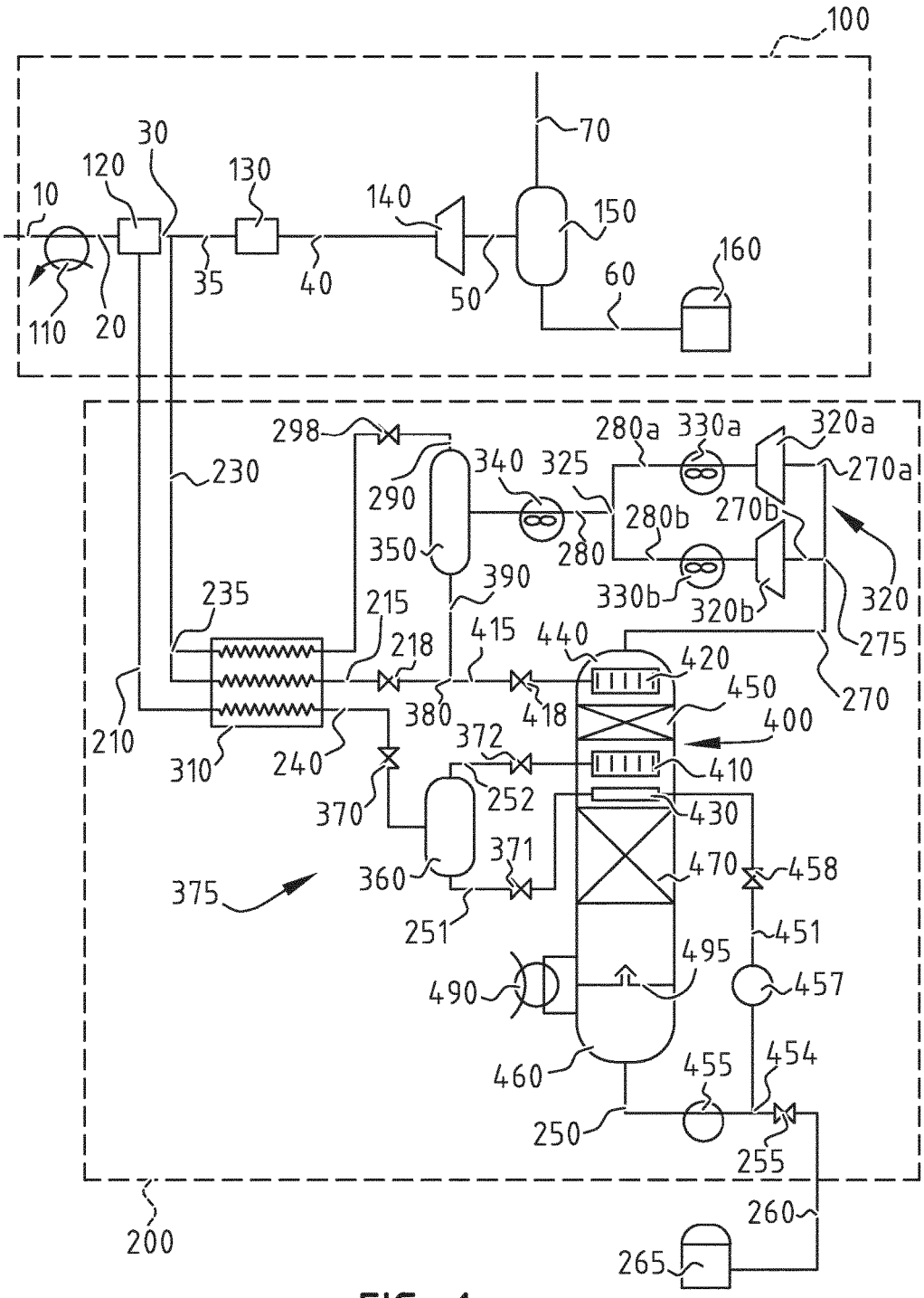

rated in an overhead separator into a vapor effluent stream and an overhead liquid stream. After discharging the overhead liquid stream from the overhead separator, it is selectively divided into a liquid reflux stream and a liquid effluent stream. The liquid reflux stream is expanded to the feed pressure and fed into the stabilizer column.

17 Claims, 2 Drawing Sheets

(51) Int. Cl.

| | |
|---|---|
| ***C10G 5/06*** | (2006.01) |
| ***C10G 7/02*** | (2006.01) |
| ***C10L 1/04*** | (2006.01) |
| ***C10L 3/06*** | (2006.01) |
| ***F25J 1/02*** | (2006.01) |

(52) U.S. Cl.
CPC ..... *C10L 3/06* (2013.01); *F25J 1/0035* (2013.01); *F25J 1/0042* (2013.01); *F25J 1/0231* (2013.01); *F25J 3/0209* (2013.01); *F25J 3/0233* (2013.01); *F25J 3/0247* (2013.01); *C10G 2300/1025* (2013.01); *C10L 2290/06* (2013.01); *C10L 2290/46* (2013.01); *C10L 2290/48* (2013.01); *C10L 2290/543* (2013.01); *F25J 2200/02* (2013.01); *F25J 2200/74* (2013.01); *F25J 2205/02* (2013.01); *F25J 2205/04* (2013.01); *F25J 2220/64* (2013.01); *F25J 2230/24* (2013.01); *F25J 2230/60* (2013.01); *F25J 2240/02* (2013.01); *F25J 2240/40* (2013.01); *F25J 2260/20* (2013.01)

(58) Field of Classification Search
CPC .. F25J 2200/74; F25J 2205/02; F25J 2205/04; F25J 2220/64; F25J 2230/60
See application file for complete search history.

(56) References Cited

U.S. PATENT DOCUMENTS

| | | | | |
|---|---|---|---|---|
| 4,964,980 | A | 10/1990 | McCarthy | |
| 5,421,165 | A | 6/1995 | Paradowski et al. | |
| 5,657,643 | A | 8/1997 | Price | |
| 5,669,234 | A | 9/1997 | Houser et al. | |
| 5,832,745 | A | 11/1998 | Klein Nagelvoort et al. | |
| 5,893,274 | A | 4/1999 | Nagelvoort et al. | |
| 6,014,869 | A | 1/2000 | Elion et al. | |
| 6,105,391 | A | 8/2000 | Capron | |
| 6,253,574 | B1 | 7/2001 | Stockmann et al. | |
| 6,295,833 | B1 | 10/2001 | Hoffart et al. | |
| 6,308,531 | B1 | 10/2001 | Roberts et al. | |
| 6,370,910 | B1 | 4/2002 | Grootjans et al. | |
| 6,389,844 | B1 | 5/2002 | Klein Nagel Voort | |
| 6,658,891 | B2 | 12/2003 | Reijnen et al. | |
| 6,658,892 | B2 | 12/2003 | Fanning et al. | |
| 6,789,394 | B2 | 9/2004 | Elion et al. | |
| 6,962,060 | B2 | 11/2005 | Petrowski et al. | |
| 7,114,351 | B2 | 10/2006 | Jones et al. | |
| 7,127,914 | B2 | 10/2006 | Roberts et al. | |
| 8,080,701 | B2 | 12/2011 | Nagal Voort et al. | |
| 9,759,481 | B2 * | 9/2017 | Paradowski ..... | F25J 3/0209 |
| 2005/0005635 | A1 | 1/2005 | Le Metais | |
| 2007/0193303 | A1 | 8/2007 | Hawrysz et al. | |
| 2008/0066492 | A1 | 3/2008 | Buijs et al. | |
| 2008/0141711 | A1 | 6/2008 | Roberts et al. | |
| 2008/0156036 | A1 | 7/2008 | Buijs et al. | |
| 2008/0156037 | A1 | 7/2008 | Van De Graaf | |
| 2009/0188279 | A1 | 7/2009 | Bras et al. | |
| 2011/0185767 | A1 | 8/2011 | Jager et al. | |
| 2013/0283851 | A1 * | 10/2013 | Higginbotham ..... | B01D 53/002 62/606 |
| 2015/0159943 | A1 * | 6/2015 | Valencia ..... | C07C 7/05 62/625 |
| 2017/0176099 | A1 * | 6/2017 | Gaskin ..... | F25J 3/0209 |

OTHER PUBLICATIONS

Rabeau et al., "How to reduce CO2 emissions in the LNG Chain" Conference paper PS2-7 at LNG 15 (Barcelona).
Johnsen et al., "LNG Production on floating platforms", presented at Gastech 1998 (Dubai).
Martin et al., "Liquefin: An Innovative Process to Reduce LNG Costs", presented at the 22nd World Gas Conference in Tokyo, Japan (2003).
Roberts et al., "Large capacity single train AP-X(TM) Hybrid LNG Process", Gastech 2002, Doha, Qatar (Oct. 13-16, 2002).

* cited by examiner

HYDROCARBON CONDENSATE STABILIZER AND A METHOD FOR PRODUCING A STABILIZED HYDROCARBON CONDENSATE STREAM

CROSS-REFERENCE TO RELATED APPLICATIONS

The present application is a National Stage (§ 371) application of PCT/EP2015/065692, filed Jul. 9, 2015, which claims the benefit of European Application No. 14178262.3, filed Jul. 24, 2014, which is incorporated herein by reference in its entirety.

The present invention relates to a hydrocarbon condensate stabilizer, and a method of producing a stabilized hydrocarbon condensate stream.

A condensate stabilizing process is disclosed in US pre-grant publication number 2009/0188279, wherein a debutanizer/stabilizer column is employed. The stabilizer column discharges a vaporous stream being enriched in butane and lower hydrocarbons (such as methane, ethane and/or propane) relative to a liquid stream being discharged from the bottom of the stabilizer column. The vaporous stream is cooled against an ambient stream in an air cooler or water cooler, and fed to an overhead condenser drum. The liquid bottom stream removed at an outlet from the overhead condenser drum is pressurized in a pump and returned as a reflux stream to the top of the stabilizer column. The remaining vapour is also removed from the overhead condenser drum and subsequently combined with another vaporous stream obtained from a gas/liquid separator. The combined vapour streams are compressed thereby obtaining a product gas which may be subjected to a liquefaction stream in one or more heat exchangers thereby obtaining liquefied natural gas (LNG).

The stabilizer column is fed by a liquid bottom stream from the gas/liquid separator. This liquid bottom stream is an unstabilized hydrocarbon condensate stream as in addition to $C_5$+ (pentanes and higher hydrocarbon components) the liquid bottom stream also may contain lighter hydrocarbons (particularly propane and/or butane). This unstabilized hydrocarbon condensate stream is indirectly heat exchanged against a major part of the liquid stream (condensate) being discharged from the bottom of the stabilizer column.

As a result of varying composition of the unstabilized hydrocarbon condensate stream, the dew point of the stabilizer column overhead vapour may vary over a wide temperature range between the multiple feed cases. With the condensate stabilizing process as disclosed in US 2009/0188279 described above, an air or water cooled condenser does not result in sufficient condensation in all these cases since the dew point of the vapour is typically close or below the ambient cooling medium supply temperatures. In other instances there may be an excess of condensation leading to too much reflux. Hence, the condensate stabilizing process as disclosed in US 2009/0188279 has the problem that a continuous top feed/reflux cannot be guaranteed in all cases.

In accordance with a first aspect of the present invention, there is provided a method of producing a stabilized hydrocarbon condensate stream, comprising:

- providing a pressurized unstabilized hydrocarbon condensate stream at a first temperature, said first temperature being below a second temperature;
- partially evaporating the pressurized unstabilized hydrocarbon condensate stream whereby the pressurized unstabilized hydrocarbon condensate stream becomes a mixed phase pressurized unstabilized hydrocarbon stream at an initial pressure;
- expanding the mixed phase pressurized unstabilized hydrocarbon stream from said initial pressure to a feed pressure;
- feeding the mixed phase pressurized unstabilized hydrocarbon stream at said feed pressure into a stabilizer column via a first inlet device into the stabilizer column;
- discharging from a bottom end of the stabilizer column a liquid phase comprising stabilized hydrocarbon condensate, wherein the bottom end of the stabilizer column is separated from the first inlet device by a first vapour/liquid contacting device;
- discharging from a top end of the stabilizer column a vapour phase comprising volatile components from the pressurized unstabilized hydrocarbon condensate stream;
- compressing the vapour phase being discharged from the top end of the stabilizer column to an auxiliary pressure, thereby forming a compressed overhead vapour stream, whereby the auxiliary pressure is higher than the feed pressure;
- passing the compressed overhead vapour stream through an ambient heat exchanger;
- passing an ambient stream through an ambient heat exchanger in indirect heat exchanging contact with the compressed overhead vapour stream, whereby passing heat from the compressed overhead vapour stream to the ambient stream as a result of which partially condensing the compressed overhead vapour stream whereby the compressed overhead vapour stream becomes a partially condensed overhead stream at said second temperature;
- passing the partially condensed overhead stream into an overhead separator and in the overhead separator separating the partially condensed overhead stream into a vapour effluent stream and an overhead liquid stream;
- discharging the vapour effluent stream from the overhead separator;
- discharging the overhead liquid stream from the overhead separator;
- selectively dividing the overhead liquid stream being discharged from the overhead separator at said second temperature into a liquid reflux stream and a liquid effluent stream;
- expanding the liquid reflux stream to the feed pressure;
- feeding the liquid reflux stream at said feed pressure into the stabilizer column via a second inlet device into the stabilizer column at a level gravitationally above the first inlet device, wherein the first inlet device and the second inlet device are separated from each other by a second vapour/liquid contacting device;
- contacting the liquid reflux stream with a vapour part of the mixed phase pressurized unstabilized hydrocarbon stream in the second vapour/liquid contacting device within the stabilizer column.

In accordance with another aspect of the invention, there is provided a hydrocarbon condensate stabilizer for producing a stabilized hydrocarbon condensate, comprising:

- a pressure line for providing a pressurized unstabilized hydrocarbon condensate stream;
- an evaporator fluidly connected to the pressure line and arranged to partially evaporate the pressurized unstabilized hydrocarbon condensate stream;
- an expansion device arranged in fluid communication with the evaporator to receive a mixed phase pressurized unstabilized hydrocarbon stream from the evaporator at an initial pressure and to expand the mixed phase pressurized unstabilized hydrocarbon stream from the initial pressure to a feed pressure;

a stabilizer column comprising a first inlet device fluidly connected to the expansion device to allow feeding of the mixed phase pressurized unstabilized hydrocarbon stream at said feed pressure into the stabilizer column, the stabilizer column further comprising a bottom end that is separated from the first inlet device by a first vapour/liquid contacting device, the stabilizer column further comprising a second inlet device at a level gravitationally above the first inlet device, wherein the first inlet device and the second inlet device are separated from each other by a second vapour/liquid contacting device, the stabilizer column further comprising a top end which top end is located in the stabilizer column gravitationally higher than the second inlet device;

a liquid discharge line fluidly connected to the bottom end of the stabilizer column and arranged to receive a liquid phase comprising stabilized hydrocarbon condensate that is discharged from the bottom end of the stabilizer column;

a vapour discharge line fluidly connected to the top end of the stabilizer column and arranged to receive a vapour phase comprising volatile components from the pressurized unstabilized hydrocarbon condensate stream that is discharged from the top end of the stabilizer column;

a compressor system arranged in the vapour discharge line for compressing the vapour phase being discharged from the top end of the stabilizer column to an auxiliary pressure, thereby forming a compressed overhead vapour stream, whereby the auxiliary pressure is higher than the feed pressure;

an overhead line connected to the vapour discharge line via the compressor system;

an ambient heat exchanger arranged in the overhead line, arranged to receive the compressed overhead vapour stream and to bring the compressed overhead vapour stream in indirect heat exchanging contact with an ambient stream, whereby passing heat from the compressed overhead vapour stream to the ambient stream as a result of which partially condensing the compressed overhead vapour stream whereby the compressed overhead vapour stream becomes a partially condensed overhead stream;

an overhead separator arranged in the overhead line for receiving the partially condensed overhead stream from the ambient heat exchanger separating the partially condensed overhead stream into a vapour effluent stream and an overhead liquid stream;

an effluent vapour line arranged to receive the vapour effluent stream being discharged from the overhead separator;

an overhead liquid line arranged to receive the overhead liquid stream being discharged from the overhead separator;

a stream splitter arranged in the overhead liquid line, for selectively dividing the overhead liquid stream being discharged from the overhead separator into a liquid reflux stream and an effluent liquid stream;

a liquid reflux line fluidly connected to the stream splitter arranged to receive the liquid reflux stream and convey the liquid reflux stream to the second inlet device into the stabilizer column;

a reflux expander arranged in the liquid reflux line between the stream splitter and the second inlet device, and arranged to expand the liquid reflux stream to the feed pressure;

an effluent liquid line fluidly connected to the stream splitter and arranged to receive the effluent liquid stream.

Figure 2:
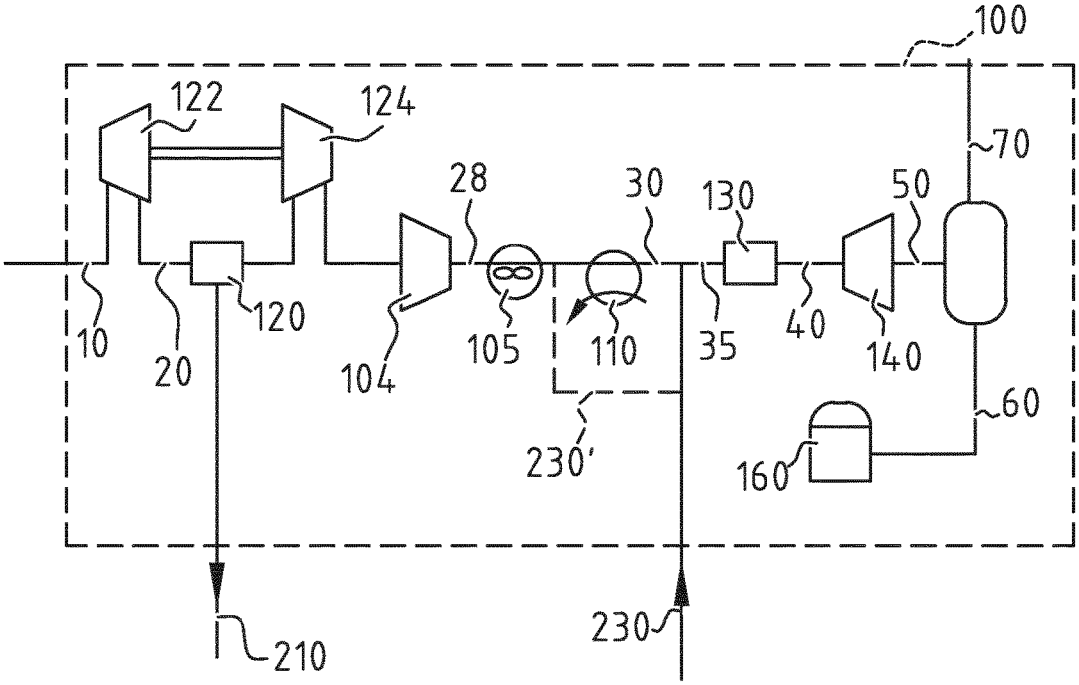

The invention will be further illustrated hereinafter by way of example only, and with reference to the non-limiting drawing in which;

FIG. 1 schematically shows a process flow representation of a natural gas liquefaction train and a hydrocarbon condensate stabilizer; and FIG. 2 schematically shows a process flow representation of an alternative natural gas liquefaction train for use with the hydrocarbon condensate stabilizer.

For the purpose of this description, a single reference number will be assigned to a line as well as a stream carried in that line. Same reference numbers refer to similar components. The person skilled in the art will readily understand that, while the invention is illustrated making reference to one or more a specific combinations of features and measures, many of those features and measures are functionally independent from other features and measures such that they can be equally or similarly applied independently in other embodiments or combinations.

A mixed phase pressurized unstabilized hydrocarbon stream is fed into a stabilizer column at a feed pressure. A liquid phase of stabilized hydrocarbon condensate is discharged from a bottom end of the stabilizer column, while a vapour phase of volatile components from the pressurized unstabilized hydrocarbon condensate stream is discharged from a top end of the stabilizer column. The vapour phase being discharged from the top end of the stabilizer column is compressed and subsequently passed through an overhead condenser wherein partial condensation takes place by indirect heat exchange against a coolant. The overhead condenser is provided in the form of an ambient heat exchanger, in which case an ambient stream (air or water) is used as the coolant. The resulting partially condensed overhead stream is separated in an overhead separator into a vapour effluent stream and an overhead liquid stream. After discharging the overhead liquid stream from the overhead separator, it is selectively divided into a liquid reflux stream and a liquid effluent stream. The liquid reflux stream is expanded to the feed pressure and fed into the stabilizer column.

One of the modifications compared to the prior art that is currently proposed is to compress the vapour phase being discharged from the top end of the stabilizer column thereby forming a compressed overhead vapour stream prior to passing through an ambient heat exchanger wherein partially condensing the compressed overhead vapour stream. As a result of the increased pressure of the compressed overhead vapour stream relative to the vapour phase being discharged from the top end of the stabilizer, the dew point temperature of the vapour increases and may be notably above the supply temperature of the typical ambient cooling medium. Thus, condensation occurs for all the feed cases when the stream is cooled and condensed using cooling against an ambient stream, which can be ambient air and/or ambient water.

Another of the proposed modifications compared to the prior art is selectively dividing the overhead liquid stream being discharged from the overhead separator into a liquid reflux stream and a liquid effluent stream. This facilitates to discharge excess liquids that may form upon the condensing of the vapour phase being discharged from the top end of the stabilizer, which may particularly happen as a result of the previous discussed modification whereby the condensation takes place at higher pressure. Hence, this second modification mitigates against undesired excess condensation.

Suitably, the pressurized unstabilized hydrocarbon condensate stream is partially evaporated in a feed-effluent heat exchanger to form a mixed phase pressurized unstabilized hydrocarbon stream out of the pressurized unstabilized hydrocarbon condensate stream prior to being fed to the stabilizer column. The vapour effluent stream from the overhead separator or the effluent liquid stream discussed above, or both, may be supplied to the feed-effluent heat exchanger to supply the heat required to partially evaporate the pressurized unstabilized hydrocarbon condensate stream. Since the vapour effluent stream and/or the effluent liquid stream have been formed by indirect heat exchanging against an ambient stream, the temperature of the vapour effluent stream and/or the effluent liquid stream is well suited to produce the mixed phase pressurized unstabilized hydrocarbon stream at a temperature that is suited for feeding into the stabilizer column at a relatively high level, above a first vapour/liquid contacting device.

Moreover, by using heat from the vapour effluent stream and/or the effluent liquid stream to partially vaporize the pressurized unstabilized hydrocarbon condensate stream, the vapour effluent stream and/or the effluent liquid stream are cooled. This is particularly beneficial if the effluent stream(s) are intended to be subject to further refrigeration as this would save on cooling duty required in the further refrigeration. Further refrigeration may suitably be done by reinjecting the effluent stream(s) in a lean natural gas stream which has passed through a liquids extraction device, whereby the liquids extraction device has served to extract the pressurized unstabilized hydrocarbon condensate stream from a natural gas stream to produce the lean natural gas stream.

Turning now to FIG. 1, there is schematically shown a natural gas liquefaction train 100 that is in fluid connection with a hydrocarbon condensate stabilizer 200.

The natural gas liquefaction train 100 is intended to implement a natural gas liquefaction process. Many such natural gas liquefaction processes are known and understood by the person skilled in the art, and need not be fully described in the present application. For the present application, a few elements or parts of the natural gas liquefaction train 100 are highlighted.

The natural gas liquefaction train 100 typically comprises one or more pre-cooling heat exchangers 110 wherein a pressurized natural gas feed stream 10 can be refrigerated. Alternatively, an expander is used to extract enthalpy from the pressurized natural gas feed stream 10. This will be further illustrated later herein, with reference to FIG. 2. Either way, a partially condensed natural gas stream 20 is created out of the pressurized natural gas feed stream 10.

The pressure of the pressurized natural gas feed stream 10 may be in the range of from 40 bara to 80 bara. The pressurized natural gas feed stream may comprise methane ("$C_1$"), ethane ("$C_2$"), propane ("$C_3$"), butanes ("$C_4$" consisting of n-butane and i-butane), and pentanes and higher hydrocarbon components ("$C_5$+"). Higher hydrocarbon components possibly include aromatics. Although this is not always the case, the pressurized natural gas feed stream may comprise one or more volatile inert components, of which typically mainly nitrogen, in addition to the other components. Volatile inert components are nitrogen, argon, and helium. These are inert components that are more volatile than methane.

The pressurized natural gas feed stream 10 may find its origin from a hydrocarbon obtained from natural gas or petroleum reservoirs or coal beds, or from another source, including as an example a synthetic source such as a Fischer-Tropsch process, or from a mix of different sources. Initially the hydrocarbon stream may comprise at least 50 mol % methane, more preferably at least 80 mol % methane.

Depending on their source, one or more of the hydrocarbon streams may contain varying amounts of components other than methane and volatile inert components, including one or more non-hydrocarbon components, such as water, $CO_2$, Hg, $H_2S$ and other sulphur compounds; and one or more hydrocarbons heavier than methane such as in particular ethane, propane and butanes, and, possibly lesser amounts of pentanes and aromatic hydrocarbons.

In those cases, the hydrocarbon streams may have been dried and/or pre-treated to reduce and/or remove one or more of undesired components such as $CO_2$, Hg, and water. Furthermore, the hydrocarbon streams may have undergone other steps such as pre-pressurizing or the like. Such steps are well known to the person skilled in the art, and their mechanisms are not further discussed here. The pressurized natural gas feed stream 10 is assumed to be the result of any selection of such steps as needed. The ultimate composition of the pressurized natural gas feed stream 10 thus varies depending upon the type and location of the gas and the applied pre-treatment(s).

Referring again to FIG. 1, the natural gas liquefaction train 100 further comprises a liquids extraction device 120. The liquids extraction device 120 serves to extract a pressurized unstabilized hydrocarbon condensate stream 210 from the partially condensed natural gas stream 20. Typically, such pressurized unstabilized hydrocarbon condensate stream comprises at least the condensed $C_5$+ components, as $C_5$+ components form the basis of the stabilized hydrocarbon condensate stream, the production of which being the aim of the proposed method and apparatus.

The liquids extraction device 120 can be any suitable type of extraction device, ranging from a fully refluxed and reboiled natural gas liquids extraction column to a simple separation vessel, or separation drum, based on only one theoretical separation stage. In between those extremes is a scrub column. Such liquids extraction device 120 is normally operated below the critical point of the pressurized natural gas feed stream 10. However, a simple separation vessel, or separation drum, based on only one theoretical separation stage may be operated in the retrograde region within the phase envelope of the pressurized natural gas feed stream 10.

A lean natural gas stream may be discharged from the liquids extraction device 120 simultaneously with the pressurized unstabilized hydrocarbon condensate stream 210. The term "lean" in the present context means that the relative amounts of $C_5$+ in the lean natural gas stream are lower than in the pressurized natural gas feed stream 10. In the embodiment of FIG. 1, the lean natural gas stream is discharged from the liquids extraction device 120 in the form of a lean pressurized refrigerated natural gas stream 30.

The natural gas liquefaction train 100 typically further comprises a further refrigerator 130, wherein the lean pressurized refrigerated natural gas stream 30 may be further refrigerated. As further refrigeration typically is performed to fully condense the lean pressurized refrigerated natural gas stream 30, the lean pressurized refrigerated natural gas stream 30 normally meets a maximum specification of solidifying components, including water, $CO_2$ and $C_5$+. Such maximum specification is governed by the need to avoid solidification. However, some operators or plant owners voluntarily choose to maintain an additional margin. In one example, the maximum specification for water may typically be less than 1 ppmv, for $CO_2$ less than 50 ppmv, and for $C_5$+ less than 0.1 mol %.

In the example of FIG. 1, an effluent stream 230 from the hydrocarbon condensate stabilizer is added to the lean pressurized refrigerated natural gas stream 30. The resulting lean pressurized refrigerated natural gas stream 35 includes the original lean pressurized refrigerated natural gas stream 30 and the effluent stream 230.

Referring still to FIG. 1, the further refrigerator 130 may discharge into an end flash unit. Such end flash unit typically comprises a pressure reduction system 140 and an end-flash separator 150 may be arranged downstream of the pressure reduction system 140 and in fluid communication therewith. The pressure reduction system 140 may comprise a dynamic unit, such as an expander turbine, a static unit, such as a Joule Thomson valve, or a combination thereof. If an expander turbine is used, it may optionally be drivingly connected to a power generator. Many arrangements are possible and known to the person skilled in the art.

In such end flash unit, the fully condensed lean pressurized refrigerated natural gas stream 40 being discharged from the further refrigerator 130 is subsequently depressurized to a pressure of for instance less than 2 bara, whereby producing a flash vapour stream 70 and a liquefied natural gas stream 60. The flash vapour stream 70 and the liquefied natural gas stream 60 may be separated from each other in the end-flash separator 150. The liquefied natural gas stream 60 is typically passed to a storage tank 160. With such end flash unit, it is possible to pass the lean pressurized refrigerated natural gas stream 30 through the further refrigerator 130 in pressurized condition, for instance at a pressure of between 40 and 80 bar absolute, or between 50 and 70 bar absolute, while storing any liquefied part of the fully condensed lean pressurized refrigerated natural gas stream 40 at substantially atmospheric pressure, such as between 1 and 2 bar absolute.

Depending on the separation requirements, governed for instance by the amount of volatile inert components in the lean pressurized refrigerated natural gas stream 30, the end flash separator may be provided in the form of a simple drum which separates vapour from liquid phases in a single equilibrium stage, or a more sophisticated vessel such as a distillation column. Non-limiting examples of possibilities are disclosed in U.S. Pat. Nos. 5,421,165; 5,893,274; 6,014,869; 6,105,391; and pre-grant publication US 2008/0066492. In some of these examples, the more sophisticated vessel is connected to a reboiler whereby the fully condensed lean pressurized refrigerated natural gas stream 40, before being expanded in said pressure reduction system, is led to pass though a reboiler in indirect heat exchanging contact with a reboil stream from the vessel, whereby the fully condensed lean pressurized refrigerated natural gas stream 40 is caused to give off heat to the reboil stream.

FIG. 2 illustrates an alternative natural gas liquefaction train 100 for use with the hydrocarbon condensate stabilizer 200. The alternative natural gas liquefaction train 100 employs an expander 122 to extract enthalpy from the pressurized natural gas feed stream 10 to create the partially condensed natural gas stream 20. Both the temperature and the pressure are lowered by the expander 122. The liquids extraction device 120 is operated at a pressure in a range of from 25 to 40 bara, and significantly (by at least 10 bar) below the pressure of the pressurized natural gas feed stream 10. Arranged downstream of the liquids extraction device 120 is a recompressor 124 followed by booster compressor 104, a compressor cooler 105. Suitably, the recompressor 124 is driven by expander 122.

The compressor cooler 105 in the embodiment of FIG. 2 is arranged to cool a lean compressed natural gas stream 28 being discharged from the booster compressor 104 by indirect heat exchange against ambient, and subsequently to discharge the lean compressed natural gas stream at a temperature no more than 10° C. above ambient temperature into the one or more pre-cooling heat exchangers 110. The lean natural gas stream that is discharged from the liquids extraction device 120 simultaneously with the pressurized unstabilized hydrocarbon condensate stream 210 can thus be recompressed and pre-cooled to form the lean pressurized refrigerated natural gas stream 30.

Similar to FIG. 1, the effluent stream 230 from the hydrocarbon condensate stabilizer may be added to the lean pressurized refrigerated natural gas stream 30. Alternatively (shown by the dashed line 230' in FIG. 2) the effluent stream 230 from the hydrocarbon condensate stabilizer may be added to the lean compressed natural gas stream 28 downstream of the compressor cooler 105 and upstream of the one or more pre-cooling heat exchangers 110.

The remaining parts in FIG. 2 correspond to like-numbered parts of FIG. 1.

Referring again to FIG. 1, an example of the hydrocarbon condensate stabilizer 200 according to one embodiment of the invention will be described in more detail. The hydrocarbon condensate stabilizer 200 typically functions to produce a stabilized hydrocarbon condensate stream 260 out of the pressurized unstabilized hydrocarbon stream 210. One or more effluent streams 230 comprising lighter components from the pressurized unstabilized hydrocarbon stream 210 are a byproduct from the hydrocarbon condensate stabilizer 200. The term "byproduct" is not intended to imply that the one or more effluent streams 230 comprising lighter components are small relative to the stabilized hydrocarbon condensate stream 260.

The pressurized unstabilized hydrocarbon condensate stream 210 is provided through a pressure line 210. In FIG. 1 the pressure line 210 is connected to the natural gas liquefaction train 100, but this is not a limiting requirement of the invention. An evaporator 310 is in fluid communication with the pressure line 210, and arranged to partially evaporate the pressurized unstabilized hydrocarbon condensate stream 210. An expansion device 375 is arranged in fluid communication with the evaporator 310, to receive a mixed phase pressurized unstabilized hydrocarbon stream 240 from the evaporator 310 at an initial pressure and to expand the mixed phase pressurized unstabilized hydrocarbon stream 240 from the initial pressure to a feed pressure. A stabilizer column 400 is fluidly connected to the expansion device 375 via at least a first inlet device 410.

The stabilizer column 400 comprises a bottom end 460 that is located gravitationally lower than the first inlet device 410. Suitably, the bottom end 460 is separated from the first inlet device 410 by a first vapour/liquid contacting device 470. Furthermore, the stabilizer column 400 comprises a second inlet device 420 at a level gravitationally above the first inlet device 410, wherein the first inlet device 410 and the second inlet device 420 are separated from each other by a second vapour/liquid contacting device 450. The stabilizer column 400 further comprises a top end 440, which top end 440 is located in the stabilizer column 400 gravitationally higher than the second inlet device 420. A liquid discharge line 250 is fluidly connected to the bottom end 460 of the stabilizer column 400, and arranged to receive a liquid phase comprising stabilized hydrocarbon condensate that is discharged from the bottom end 460 of the stabilizer column 400. A vapour discharge line 270 is fluidly connected to the top end 440 of the stabilizer column 400, and arranged to receive a vapour phase comprising volatile components from the pressurized unstabilized hydrocarbon condensate stream 210 that is discharged from the top end 440 of the stabilizer column 400.

The first vapour/liquid contacting device 470 and/or the second vapour/liquid contacting device 450 may be embodied in any suitable form. They may be based on a number of contact trays, or on packing. Contact trays are available in a number of common variants, including sieve trays, valve trays, and bubble cap trays. Packing has at least two common variants: structured packing and random packing. A slight preference exists for structured packing.

The expansion device 375 may be provided in the form of a simple Joule-Thomson valve or it may have higher complexity. Regardless of the specific implementation of the expansion device 375, its function is to allow feeding of the mixed phase pressurized unstabilized hydrocarbon stream 240 at said feed pressure into the stabilizer column 400.

In the example shown in FIG. 1, the expansion device 375 actually comprises three Joule-Thomson valves (a first Joule-Thomson valve 370 and first and second feed Joule-Thomson valves 371 and 372), and an inlet separator 360. The inlet separator may be configured in the form of a drum. The inlet separator 360 on an upstream side thereof is separated from the evaporator 310 by the first Joule-Thomson valve 370. On a downstream side the inlet separator 360 is separated from the stabilizer column 400 via both the first and second feed Joule-Thomson valves 371 and 372. The first feed Joule-Thomson valve 371 is configured in a liquid hydrocarbon feed line 251, which extends between a bottom outlet in the inlet separator 360 and a third inlet device 430 into the stabilizer column 400. The third inlet device 430 is located gravitationally below the first inlet device 410 and above the first vapour/liquid contacting device 470. The second feed Joule-Thomson valve 372 is configured in a vapour hydrocarbon feed line 255, which extends between a vapour outlet in the inlet separator 360 and the first inlet device 410 into the stabilizer column 400.

An overhead compressor system 320 is arranged in the vapour discharge line 270, for compressing the vapour phase being discharged from the top end 440 of the stabilizer column 400 to an auxiliary pressure, thereby forming a compressed overhead vapour stream 280. The auxiliary pressure is higher than the feed pressure. An overhead line 280 is connected to the vapour discharge line 270 via the compressor system 320. The overhead compressor system 320 may further be provided with one or more compressor suction drums (not shown) to protect any overhead compressor in the overhead compressor system 320 against possible liquids that might be present in the vapour discharge line 270.

In the embodiment of FIG. 1, the overhead compressor system 320 comprises a plurality (in this specific case the plurality is formed by two) overhead compressors (320*a*, 320*b*) arranged in parallel operation with each other. This allows to selectively take one of the overhead compressors off-line during operation in turn-down, which allows for a reduction of anti-sure recirculation rate and consequently a reduction in power consumption during operation under turn-down conditions. Upstream of the overhead compressor system 320, the vapour discharge line 270 is split over a number of vapour discharge part lines (270*a*, 270*b*) by a vapour splitter 275, whereby each vapour discharge part line supports a part stream. Each vapour discharge part line feeds into one of the overhead compressors (320*a*, 320*b*) whereby each of the overhead compressors is addressed by one of the vapour discharge part lines. At least one overhead compressor is provided per part stream. This way the vapour phase being discharged from the top end 440 of the stabilizer column 400 can be divided into two or more part streams, whereby each of the part streams is passed through one of the overhead compressors in the overhead compressor system 320. An equal number of compressed overhead vapour part streams 280*a*, 280*b* is thus produced at the auxiliary pressure as there are vapour discharge part streams.

The overhead compressor system 320 may further comprise a de-superheater. In the embodiment as illustrated in FIG. 1, at least one de-superheater (330*a*, 330*b*) is provided in each of the compressed overhead vapour part streams 280*a*, 280*b*.

At the end of the overhead compressor system 320, all of the compressed overhead vapour part streams are recombined in a recombiner 325, which discharges into the overhead line 280.

Regardless of the specific lay out of the overhead compressor system 320, an ambient heat exchanger 340 is arranged in the overhead line 280. This ambient heat exchanger 340 is arranged to receive the compressed overhead vapour stream and bring the compressed overhead vapour stream in indirect heat exchanging contact with an ambient stream, whereby passing heat from the compressed overhead vapour stream to the ambient stream. As a result the compressed overhead vapour stream is partially condensed, whereby the compressed overhead vapour stream becomes a partially condensed overhead stream at the second temperature.

An overhead separator 350 is arranged in the overhead line 280 downstream of the ambient heat exchanger 340 and in fluid communication therewith. This overhead separator 350 is configured to receive the partially condensed overhead stream from the ambient heat exchanger 340, and to separate the partially condensed overhead stream into a vapour effluent stream and an overhead liquid stream. An effluent vapour line 290 is arranged to receive the vapour effluent stream being discharged from the overhead separator 350, and an overhead liquid line 390 is arranged to receive the overhead liquid stream being discharged from the overhead separator 350.

A stream splitter 380 is arranged in the overhead liquid line 390, for selectively dividing the overhead liquid stream being discharged from the overhead separator 350 at the second temperature into a liquid reflux stream and an effluent liquid stream. A liquid reflux line 415 is fluidly connected to the stream splitter 380, and arranged to receive the liquid reflux stream. The liquid reflux line 415 serves to convey the liquid reflux stream to the second inlet device 420 into the stabilizer column 400. A reflux expander 418 may be configured in the liquid reflux line 415 between the stream splitter 380 and the second inlet device 420 to adopt the pressure of the liquid reflux stream to the feed pressure. The reflux expander 418 also serves to regulate the flow rate of the liquid reflux stream in the liquid reflux line 415. An effluent liquid line 215 is also fluidly connected to the stream splitter 380. The effluent liquid line 215 is arranged to receive the effluent liquid stream.

The evaporator 310 may be any type of heat exchanger capable of adding heat to the pressurized unstabilized hydrocarbon condensate stream 210. In advantageous embodiments, the evaporator 310 is provided in the form of a feed-effluent heat exchanger as illustrated in FIG. 1. The feed-effluent heat exchanger is arranged to bring an effluent stream comprising, preferably consisting of, one or both of the effluent liquid stream and the vapour effluent stream in indirect heat exchanging contact with the incoming pressurized unstabilized hydrocarbon condensate stream. The effluent liquid line 215 and/or the effluent vapour line 290 extends between the overhead separator 350 and the feed-effluent heat exchanger. An effluent stream combiner 235 may be provided in both the effluent liquid line 215 and the effluent vapour line 290 to combine effluent liquid stream and the vapour effluent stream in a single effluent stream 230. The effluent stream combiner 235 may be positioned upstream of the feed-effluent heat exchanger 310 between the overhead separator and the feed-effluent heat exchanger 310, but the effluent stream combiner 235 is preferably positioned downstream of the feed-effluent heat exchanger 310 as this facilitates the use of printed circuit or plate-fin type heat exchanger.

A flow regulating valve 218 may be configured in the effluent liquid line 215 between the overhead separator 350 and the feed-effluent heat exchanger. This flow regulating valve 218 is suitably liquid level controlled to keep a level of liquid resident in the overhead separator 350 within two acceptable predetermined limits. A pressure controlled valve 298 may be configured in the effluent vapour line 290 between the overhead separator 350 and the feed-effluent heat exchanger. Herewith the pressure in the overhead separator 350 can be kept constant.

Preferably, the stabilizer column 400 is a reboiled stabilizer column, whereby a heat source 490 is arranged to add heat to the bottom end 460 of the stabilizer column 400 below the first vapour/liquid contacting device 470. The heat source 490, commonly referred to as reboiler, is connected to a liquid draw off device 495 (such as a chimney plate) configured in the stabilizer column 400 and discharges heated liquid back into the bottom end 460 of the stabilizer column 400. Heat may be provided by indirect heat exchange against for instance hot oil.

A condensate cooler 455 may be configured in the liquid discharge line 250, to cool the liquid phase being discharged from the bottom end 460 of the stabilizer column 400 and thus create a cooled stream comprising the stabilized hydrocarbon condensate. A condensate splitter 454 may optionally be arrange in the liquid discharge line 250 downstream of the condensate cooler 455. This condensate splitter 454 serves to split the cooled stream comprising the stabilized hydrocarbon condensate into a recycle stream and a discharge stream. The condensate splitter 454 is fluidly connected to a condensate storage tank 265, optionally via a condensate flow valve 255, to convey the discharge stream to the condensate storage tank 265. The condensate splitter 454 is also connected to a condensate recycle line 451 to route the recycle stream back to the stabilizer column 400 at a level above the first vapour/liquid contacting device 470 and below the first inlet device 410. The third inlet device 430 can be used for this purpose. Suitably, the condensate recycle line 451 connects to the stabilizer column 400 via the liquid hydrocarbon feed line 251. Alternatively, the condensate recycle line 451 directly connects to the the third inlet device 430. A pump 457 is suitably configured in the condensate recycle line 451. Optionally, a recycle flow control valve 458 is configured in the condensate recycle line 451 as well, to control the recycle flow rate. Suitably, the recycle flow control valve 451 is configured at the high-pressure discharge side of the pump 457 to avoid cavitation.

In operation, the system of FIG. 1 works as described below. A pressurized natural gas feed stream 10 is provided. The pressurized natural gas feed stream 10 typically comprises $C_1$ to $C_4$, $C_5$+ components and optional volatile inert components. Preferably, at least 80 mol % consists of methane and any volatile inert components. Preferably, at least 90 mol % consists of methane and any volatile inert components. Not all of the volatile inert components need to be present in the pressurized natural gas feed stream 10. The amount of volatile inert components in the pressurized natural gas feed stream 10 is preferably less than 30 mol %, more preferably less than 10 mol %, most preferably less than 5 mol %.

The pressurized natural gas feed stream 10 is refrigerated, for instance in the one or more pre-cooling heat exchangers 110 as in the example of FIG. 1, or expanded as in the example of FIG. 2, whereby creating a partially condensed natural gas stream 20 and whereby condensing at least the $C_5$+ components from the pressurized natural gas feed stream 10. The partially condensed natural gas stream 20 is passed through the liquids extraction device 120, where the pressurized unstabilized hydrocarbon condensate stream 210 is extracted from the partially condensed natural gas stream 20.

The pressurized unstabilized hydrocarbon condensate stream 210 comprises at least the condensed $C_5$+ components, and one or more of $C_1$ to $C_4$ components. The amount of methane and any volatile inert components in the pressurized unstabilized hydrocarbon condensate stream 210 may be in the range of from 50 mol % to 80 mol %, preferably in the range of from 60 mol % to 80 mol % of the pressurized unstabilized hydrocarbon condensate stream 210. Not all of the volatile inert components need to be present. The amount of volatile inert components in the pressurized unstabilized hydrocarbon condensate stream less than 10 mol %, preferably less than 2 mol %, of the pressurized unstabilized hydrocarbon condensate stream. Practically all of the methane and any volatile inert components will leave the stabilizer column 400 via the vapour discharge line 270, causing a relatively low dew point of the vapour phase in the vapour discharge line 270.

The pressurized unstabilized hydrocarbon condensate stream 210 is discharged from the liquids extraction device 120 at a first temperature. The first temperature is preferably below the ambient temperature. For example, the first temperature may be in a first temperature range of from −80° C. to −30° C. Preferably the upper limit of the first temperature range is −40° C. Preferably, the lower limit of the first temperature range is −70° C. The pressure may be close to the pressure of the pressurized natural gas feed stream 10, in the range of from 40 bara to 80 bara, or a few bar (between 2 and 10 bar) below the pressure of the pressurized natural gas feed stream 10, or significantly below the pressure of the pressurized natural gas feed stream 10 (by between 10 bar and 50 bar). In one example, the pressure was 59 bara, close to the pressure of the pressurized natural gas feed stream 10.

Simultaneously with the pressurized unstabilized hydrocarbon condensate stream 210, a lean natural gas stream is also discharged from the liquids extraction device 120. In the embodiment of FIG. 1, the lean natural gas stream is being discharged in the form of a lean pressurized refrigerated natural gas stream 30. In the embodiment of FIG. 2, the lean natural gas stream is subject to recompression in recompressor 124 followed by booster compressor 104. This provides a lean compressed natural gas stream 28. Heat is removed from the lean compressed natural gas stream 28 by indirect heat exchanging against ambient in compressor cooler 105 and subsequently refrigerating in the one or more pre-cooling heat exchangers 110, thereby forming the lean pressurized refrigerated natural gas stream 30.

In either embodiment, the lean pressurized refrigerated natural gas stream 30 is then further refrigerated in the further refrigerator 130, whereby fully condensing the lean pressurized refrigerated natural gas stream. Subsequently, the lean pressurized refrigerated natural gas stream is depressurized, whereby producing a flash vapour stream and a liquefied natural gas stream. The pressure after the depressurizing is typically between 1 and 2 bara. The temperature of the liquefied natural gas stream is below −155° C., and usually below −160° C. The temperature of the liquefied natural gas stream may typically be −162° C.

The pressurized unstabilized hydrocarbon condensate stream 210 is then partially evaporated, whereby the pressurized unstabilized hydrocarbon condensate stream becomes a mixed phase pressurized unstabilized hydrocarbon stream 240 at an initial pressure. The mixed phase pressurized unstabilized hydrocarbon stream 240 is then expanded from said initial pressure to a feed pressure, and fed at the feed pressure into the stabilizer column 400 via the first inlet device 410. The feed pressure may be in a feed pressure range of from 2 bara to 25 bara, preferably in a feed pressure range of from 2 bara to 20 bara. Preferably, the lower limit of these ranges is 5 bara. In one example, the feed pressure was 12 bara.

The expanding of the mixed phase pressurized unstabilized hydrocarbon stream 240 from the initial pressure to the feed pressure and the feeding of the mixed phase pressurized unstabilized hydrocarbon stream 240 into the stabilizer column 400 may be done in a variety of ways. In the example of FIG. 1, the mixed phase pressurized unstabilized hydrocarbon stream 240 is separated in the inlet separator 360 into a pressurized liquid hydrocarbon feed stream 251 and a pressurized vapour hydrocarbon feed stream 252. After discharging the pressurized vapour hydrocarbon feed stream 252 from the inlet separator 360, the pressurized vapour hydrocarbon feed stream 252 is passed into the stabilizer column 400 via the second feed Joule-Thomson valve 372 and the first inlet device 410. After discharging the pressurized liquid hydrocarbon feed stream 251 from the inlet separator 360, the pressurized liquid hydrocarbon feed stream 251 is passed into the stabilizer column 400 via the first feed Joule-Thomson valve 371 the third inlet device 430.

Optionally, and as illustrated in FIG. 1, the pressure of the mixed phase pressurized unstabilized hydrocarbon stream 240 is lowered from the initial pressure to an intermediate pressure while the mixed phase pressurized unstabilized hydrocarbon stream 240 is being passed from the evaporator 310 to the inlet separator 360. The lowering of the pressure from the initial pressure to an intermediate pressure can be performed in the first Joule-Thomson valve 370. The intermediate pressure is lower than the initial pressure and higher than the feed pressure. For instance, the intermediate pressure is in an intermediate pressure range of from 25 bara to 60 bara. Preferably, the upper limit of the intermediate pressure range is 50 bara, and more preferably 40 bara. The separation of the mixed phase pressurized unstabilized hydrocarbon stream 240 in the inlet separator 360 is carried out at the intermediate pressure.

A liquid phase comprising stabilized hydrocarbon condensate is discharged from the bottom end 460 of the stabilizer column 400. A vapour phase comprising volatile components from the pressurized unstabilized hydrocarbon condensate stream 210 is discharged from the top end 440 of the stabilizer column 400.

The vapour phase being discharged from the top end 440 of the stabilizer column 400 is passed to the overhead compressor system 320 where it is compressed to an auxiliary pressure. The compressed vapour phase may optionally also be de-superheated in the overhead compressor system 320. A compressed overhead vapour stream is discharged from the overhead compressor system 320. The auxiliary pressure is higher than the feed pressure. In one example, the auxiliary pressure is 62 bara.

The step of compressing the vapour phase in the overhead compressor system 320 may, as illustrated in FIG. 1, comprise selectively dividing the vapour phase being discharged from the top end 440 of the stabilizer column 400 into two or more part streams, and passing each of the part streams through one of the overhead compressors. At least one overhead compressor is configured per part stream, and an equal number of overhead part streams is provided at the auxiliary pressure as there are part streams.

Suitably, each of the overhead part streams are de-superheated by passing each of the overhead part streams through a de-superheater heat exchanger whereby at least one de-superheater heat exchanger is provided per overhead part stream.

All of the overhead part streams are recombined to form the compressed overhead vapour stream that is passed through the ambient heat exchanger 340. Prior to being passed through the ambient heat exchanger 340, but subsequent to de-superheating, the temperature of the compressed overhead vapour stream is preferably between 50° C. and 80° C. Particularly in case of surge recycle lines being provided around the overhead compressors, it is important that the de-superheated streams are guaranteed to be above dew point. Hence, it is recommended to avoid de-superheating to below 50° C.

The compressed overhead vapour stream is then passed through the ambient heat exchanger 340. At the same time, an ambient stream is passed through the ambient heat exchanger 340, in indirect heat exchanging contact with the compressed overhead vapour stream. Hereby heat is allowed to pass from the compressed overhead vapour stream to the ambient stream, as a result of which the compressed overhead vapour stream is partially condensed whereby the compressed overhead vapour stream becomes a partially condensed overhead stream at a second temperature. The ambient stream as it passes into the ambient heat exchanger 340 is at an ambient temperature prior to said indirect heat exchanging contact with the compressed overhead vapour stream. The second temperature is higher than the first temperature. The second temperature is below the dew point of the compressed overhead vapour stream at the auxiliary pressure, and above the temperature at which the ambient stream is fed into the ambient heat exchanger 340. Typically, the second temperature is in a second temperature range of from 0° C. to 20° C.

The partially condensed overhead stream is passed into the overhead separator 350, where it is separated in the vapour effluent stream and the overhead liquid stream. The vapour effluent stream is discharged from the overhead separator 350. The overhead liquid stream is also discharged from the overhead separator 350, and subsequently selectively divided into the liquid reflux stream 415 and the liquid effluent stream 215. The liquid reflux stream 415 is expanded to the feed pressure, and fed at the feed pressure into the stabilizer column 400 via the second inlet device 420. The liquid reflux stream contacts with a vapour part of the mixed phase pressurized unstabilized hydrocarbon stream 240 in the second vapour/liquid contacting device 450 within the stabilizer column 400.

Heat from the heat source 490 is preferably added to the bottom end 460 of the stabilizer column 400, below the first vapour/liquid contacting device 470. This heat may be furnished from a reboiler. The liquid phase comprising the stabilized hydrocarbon condensate being discharged from the bottom end 460 of the stabilizer column 400 is preferably cooled in condensate cooler 455, whereby heat is discharged from the liquid phase. The liquid phase thereby becomes a cooled stream comprising the stabilized hydrocarbon condensate. In a preferred embodiment, the cooled stream comprising the stabilized hydrocarbon condensate is split in the condensate splitter 454 into a recycle stream and a discharge stream. The discharge stream can then be passed to the condensate storage tank 265. The recycle stream on the other hand, can be pumped in pump 457 up to above the first vapour/liquid contacting device 470 and below the first inlet device 410. The recycle stream may then be fed back into the stabilizer column 400 at a level above the first vapour/liquid contacting device 470 and below the first inlet device 410, and at a first flow rate.

A second flow rate may be determined of the pressurized liquid hydrocarbon feed stream 251 being discharged from the inlet separator 360. The first flow rate is suitably adjusted, whereby the sum of the first flow rate and the second flow rate exceeds a pre-determined minimum liquid feed rate into the stabilizer column 400.

The partially evaporating of the pressurized unstabilized hydrocarbon condensate stream 210 in the evaporator 310 preferably comprises indirectly heat exchanging the pressurized unstabilized hydrocarbon condensate stream 210 in the feed-effluent heat exchanger against at least one of the effluent streams being fed to the feed-effluent heat exchanger at the second temperature. The effluent stream at said second temperature consists of one or both of the vapour effluent stream 290 and the liquid effluent stream 215. The vapour effluent stream 290 being discharged from the overhead separator 350 may thus advantageously be passed to the feed-effluent heat exchanger, suitably via the pressure controlled valve 298. In addition thereto or instead thereof, the liquid effluent stream 215 may be passed to the feed-effluent heat exchanger, suitably via flow regulating valve 218.

The effluent stream 230 being discharged from the feed-effluent heat exchanger is advantageously recombined with the lean pressurized refrigerated natural gas stream 30. This is done prior to said further refrigerating, such that the resulting lean pressurized refrigerated natural gas stream 35 which includes the original lean pressurized refrigerated natural gas stream 30 and the effluent stream 230 are further refrigerated together. This can be done because there are abundant volatile components (notably methane and any volatile inert components) in the pressurized unstabilized hydrocarbon condensate stream 210 being fed into the hydrocarbon condensate stabilizer 200. The molar flow rate of the effluent stream is preferably not more than 15% of the molar flow rate of the resulting lean pressurized refrigerated natural gas stream 35. Under typical conditions, the molar flow rate of the effluent stream may be between 5% and 15% of the molar flow rate of the resulting lean pressurized refrigerated natural gas stream 35.

The hydrocarbon condensate stabilizer 200 has been modeled in SimSci Pro/II to demonstrate its merits. Two cases are presented below, an average gas average ambient case (AGAA) and a rich gas cold ambient case (RGCA). The temperature of the ambient stream entering the ambient heat exchanger 340 was assumed to be 10° C. in the average ambient case, and 4° C. in the cold ambient case. Additionally, the AGAA case has been simulated at 50% turndown. In all cases the Reid vapour pressure of the stabilized hydrocarbon condensate was 0.80 bara.

Table 1 shows the composition, temperature and pressure of the partially condensed natural gas stream 20, the pressurized unstabilized hydrocarbon condensate stream 210, the vapour phase being discharged from the stabilizer column 400 in vapour discharge line 270, and of the liquid phase in liquid discharge line 250, in the AGAA case for FIG. 1.

TABLE 1

| AGAA | Stream | | | |
|---|---|---|---|---|
| | 20 | 210 | 270 | 250 |
| Nitrogen (mol %) | 0.32 | 0.08 | 0.07 | 0.000 |
| Methane (mol %) | 94.2 | 64.1 | 60.2 | 0.000 |
| Ethane (mol %) | 4.1 | 13.1 | 15.0 | 0.000 |
| Propane (mol %) | 0.96 | 9.2 | 13.0 | 0.001 |
| i-butane (mol %) | 0.14 | 2.7 | 4.6 | 0.15 |
| n-butane (mol %) | 0.15 | 3.8 | 6.3 | 2.5 |
| $C_5$+ (mol %) | 0.13 | 7.0 | 0.8 | 97.3 |
| Temperature (° C.) | −50 | −50 | 13 | 150 |
| Pressure (bara) | 59 | 59 | 12 | 12 |

The pressure and temperature of the compressed overhead vapour stream 280 downstream of the de-superheater but upstream of the ambient heat exchanger 340 are 62 bar and 70° C. The dew point of the vapour phase being discharged from the stabilizer column 400 changes from 12° C. to 55° C. as a result of the compression. In the AGAA case, a recycle flow of the recycle stream from the stabilized hydrocarbon condensate is pumped up through condensate recycle line 451, and fed back into the stabilizer column at a level above the first vapour/liquid contacting device 470 and below the first inlet device 410.

For comparison, Table 2 below shows the composition, temperature and pressure of the partially condensed natural gas stream 20, the pressurized unstabilized hydrocarbon condensate stream 210, the vapour phase being discharged from the stabilizer column 400 in vapour discharge line 270, and of the liquid phase in liquid discharge line 250, in the RGCA case for FIG. 1. No recycle flow through condensate recycle line 451 was needed in this case.

TABLE 2

| RGCA | Stream | | | |
|---|---|---|---|---|
| | 20 | 210 | 270 | 250 |
| Nitrogen (mol %) | 0.3 | 0.10 | 0.10 | 0.000 |
| Methane (mol %) | 91.0 | 70.0 | 70.6 | 0.000 |
| Ethane (mol %) | 6.0 | 14.9 | 15.4 | 0.000 |
| Propane (mol %) | 1.7 | 8.1 | 8.7 | 0.001 |
| i-butane (mol %) | 0.35 | 2.2 | 2.4 | 0.13 |

TABLE 2-continued

| RGCA | Stream | | | |
|---|---|---|---|---|
| | 20 | 210 | 270 | 250 |
| n-butane (mol %) | 0.35 | 2.4 | 2.6 | 1.8 |
| $C_5$+ (mol %) | 0.30 | 2.5 | 0.23 | 98.1 |
| Temperature (° C.) | −52 | −52 | −8 | 150 |
| Pressure (bara) | 59 | 59 | 12 | 12 |

The pressure and temperature of the compressed overhead vapour stream 280 downstream of the de-superheater but upstream of the ambient heat exchanger 340 are 62 bar and 70° C. The dew point of the vapour phase being discharged from the stabilizer column 400 changes from −8° C. to 26° C. as a result of the compression.

Table 3 below repeats the simulation for the same gas composition and ambient temperature as the AGAA case, but at 50% of the flow rate. The pressure and temperature of the compressed overhead vapour stream 280 downstream of the de-superheater but upstream of the ambient heat exchanger 340 are the same as in the AGAA case. The dew point of the vapour phase being discharged from the stabilizer column 400 changes from 20° C. to 65° C. as a result of the compression. The recycle flow rate of the

TABLE 3

| AGAA 50% turndown | Stream | | | |
|---|---|---|---|---|
| | 20 | 210 | 270 | 250 |
| Nitrogen (mol %) | 0.32 | 0.08 | 0.06 | 0.000 |
| Methane (mol %) | 94.2 | 64.1 | 54.8 | 0.000 |
| Ethane (mol %) | 4.1 | 13.1 | 15.6 | 0.000 |
| Propane (mol %) | 0.96 | 9.2 | 15.0 | 0.001 |
| i-butane (mol %) | 0.14 | 2.7 | 5.6 | 0.15 |
| n-butane (mol %) | 0.15 | 3.8 | 7.8 | 2.6 |
| $C_5$+ (mol %) | 0.13 | 7.0 | 1.2 | 97.2 |
| Temperature (° C.) | −50 | −50 | 20 | 150 |
| Pressure (bara) | 59 | 59 | 12 | 12 |

recycle stream from the stabilized hydrocarbon condensate through condensate recycle line 451 was higher than in the AGAA case in order to maintain sufficient liquid loading to operate the stabilizer column 400. The dew point increases slightly in comparison to AGAA case.

The presently proposed hydrocarbon condensate stabilizer 200 can be employed with any type of natural gas liquefaction process or train. Examples of suitable liquefaction processes or trains may employ single refrigerant cycle processes (usually single mixed refrigerant—SMR—processes, such as PRICO described in the paper "LNG Production on floating platforms" by K R Johnsen and P Christiansen, presented at Gastech 1998 (Dubai). Also possible is a single component refrigerant such as for instance the BHP-cLNG process which is also described in the afore-mentioned paper by Johnsen and Christiansen). Other examples employ double refrigerant cycle processes (for instance the much applied Propane-Mixed-Refrigerant process, often abbreviated C3MR, such as described in for instance U.S. Pat. No. 4,404,008, or for instance double mixed refrigerant—DMR—processes of which an example is described in U.S. Pat. No. 6,658,891, or for instance two-cycle processes wherein each refrigerant cycle contains a single component refrigerant). Still other processes or trains are based on three or more compressor trains for three or more refrigeration cycles of which an example is described in U.S. Pat. No. 7,114,351.

Additional specific examples of liquefaction processes and trains are described in: U.S. Pat. No. 5,832,745 (Shell SMR); U.S. Pat. Nos. 6,295,833; 5,657,643 (both are variants of Black and Veatch SMR); U.S. Pat. No. 6,370,910 (Shell DMR). Another suitable example of DMR is the so-called Axens LIQUEFIN process, such as described in for instance the paper entitled "LIQUEFIN: AN INNOVATIVE PROCESS TO REDUCE LNG COSTS" by P-Y Martin et al, presented at the 22$^{nd}$ World Gas Conference in Tokyo, Japan (2003). Other suitable three-cycle processes include for example U.S. Pat. No. 6,962,060; US 2011/185767; U.S. Pat. No. 7,127,914; AU4349385; U.S. Pat. No. 5,669,234 (commercially known as optimized cascade process); U.S. Pat. No. 6,253,574 (commercially known as mixed fluid cascade process); U.S. Pat. No. 6,308,531; US application publication 2008/0141711; Mark J. Roberts et al "Large capacity single train AP-X™ Hybrid LNG Process", Gastech 2002, Doha, Qatar (13-16 Oct. 2002).

Other possibilities include so-called parallel mixed refrigerant processes, such as described for instance in U.S. Pat. No. 6,389,844 (Shell PMR process), US Patent application publication Nos. 2005/005635, 2008/156036, 2008/156037, or Pek et al in "LARGE CAPACITY LNG PLANT DEVELOPMENT" 14th International Conference on Liquefied Natural Gas, Doha, Qatar (21-24 Mar. 2004); or full dependent or independent natural gas liquefaction trains such as described in for instance U.S. Pat. No. 6,658,892; or single trains comprising multiple parallel main cryogenic heat exchangers such as described in for instance U.S. Pat. No. 6,789,394, US Patent pre-grant publication No. 2007/193303, or by Paradowski et al in "An LNG train capacity of 1 BSCFD is a realistic objective", Presented at GPA European Chapter Annual Meeting, Barcelona, Spain (27-29 Sep. 2000).

These suggestions are provided to demonstrate wide applicability of the invention, and are not intended to be an exclusive and/or exhaustive list of possibilities.

The person skilled in the art will understand that the present invention can be carried out in many various ways without departing from the scope of the appended claims.

The invention claimed is:

1. A method of producing a stabilized hydrocarbon condensate stream, comprising:

providing a pressurized unstabilized hydrocarbon condensate stream at a first temperature, said first temperature being below a second temperature;

partially evaporating the pressurized unstabilized hydrocarbon condensate stream whereby the pressurized unstabilized hydrocarbon condensate stream becomes a mixed phase pressurized unstabilized hydrocarbon stream at an initial pressure;

expanding the mixed phase pressurized unstabilized hydrocarbon stream from said initial pressure to a feed pressure;

providing the mixed phase pressurized unstabilized hydrocarbon stream at said feed pressure to a stabilizer column at a first inlet location;

discharging from a bottom end of the stabilizer column a liquid phase comprising stabilized hydrocarbon condensate, wherein a first vapour/liquid contacting device configured to allow contact of the vapour and liquid in the stabilizer column is located between the bottom end of the stabilizer column and the first inlet location;

discharging from a top end of the stabilizer column a vapour phase;

compressing the vapour phase being discharged from the top end of the stabilizer column to an auxiliary pressure, thereby forming a compressed overhead vapour stream, whereby the auxiliary pressure is higher than the feed pressure;

passing the compressed overhead vapour stream through a heat exchanger;

passing a coolant stream having a temperature lower than the temperature of the compressed overhead vapour stream through the heat exchanger in indirect heat exchanging contact with the compressed overhead vapour stream, whereby heat from the compressed overhead vapour stream is passed to the coolant stream, wherein the compressed overhead vapour stream becomes a partially condensed overhead stream at said second temperature;

passing the partially condensed overhead stream into an overhead separator and in the overhead separator separating the partially condensed overhead stream into a vapour effluent stream and a liquid stream;

discharging the vapour effluent stream from the overhead separator;

discharging the liquid stream from the overhead separator;

dividing the overhead liquid stream being discharged from the overhead separator at said second temperature into a liquid reflux stream and a liquid effluent stream;

expanding the liquid reflux stream to the feed pressure;

providing the liquid reflux stream at said feed pressure to the stabilizer column at a second inlet location, said second inlet location being at a level gravitationally above the first inlet location, wherein a second vapour/liquid contacting device configured to allow contact of the vapour and liquid in the stabilizer column is located between the first inlet location and the second inlet location;

contacting the liquid reflux stream with a vapour part of the mixed phase pressurized unstabilized hydrocarbon stream in the second vapour/liquid contacting device within the stabilizer column.

2. The method of claim 1, wherein pressurized unstabilized hydrocarbon condensate stream comprises at least condensed $C_5$+ components, methane, whereby the amount of methane is in the range of from 50 mol % to 80 mol % of the pressurized unstabilized hydrocarbon condensate stream.

3. The method of claim 1, wherein said partially evaporating the pressurized unstabilized hydrocarbon condensate stream comprises indirectly heat exchanging the pressurized unstabilized hydrocarbon condensate stream in a feed-effluent heat exchanger against an effluent stream being fed to the feed-effluent heat exchanger at the second temperature, wherein the effluent stream at said second temperature consists of one or both of the vapour effluent stream and the liquid effluent stream.

4. The method of claim 3, wherein the effluent stream at said second temperature comprises the liquid effluent stream, said method further comprising:

passing the liquid effluent stream to the feed-effluent heat exchanger.

5. The method of claim 1, wherein the first temperature is below the temperature of said coolant stream and the second temperature is above the temperature of said coolant stream.

6. The method of claim 1, further comprising adding heat from a heat source to the bottom end of the stabilizer column below the first vapour/liquid contacting device.

7. The method of claim 1, wherein said expanding the mixed phase pressurized unstabilized hydrocarbon stream from said initial pressure to a feed pressure and said providing of the mixed phase pressurized unstabilized hydrocarbon stream to the stabilizer column both comprise:

passing the mixed phase pressurized unstabilized hydrocarbon stream into an inlet separator;

separating the mixed phase pressurized unstabilized hydrocarbon stream into a pressurized liquid hydrocarbon feed stream and a pressurized vapour hydrocarbon feed stream;

discharging the pressurized vapour hydrocarbon feed stream from the inlet separator;

passing the pressurized vapour hydrocarbon feed stream being discharged from the inlet separator into the stabilizer column at the first inlet location;

discharging the pressurized liquid hydrocarbon feed stream from the inlet separator;

passing the pressurized liquid hydrocarbon feed stream being discharged from the inlet separator into the stabilizer column at a third location located gravitationally below the first inlet location and above the first vapour/liquid contacting device.

8. The method of claim 7, wherein said passing of said mixed phase pressurized unstabilized hydrocarbon stream into the inlet separator comprises lowering the pressure from the initial pressure to an intermediate pressure which is lower than the initial pressure and higher than the feed pressure, and further carrying out said separating of the mixed phase pressurized unstabilized hydrocarbon stream in the inlet separator at said intermediate pressure.

9. The method of claim 7, further comprising the steps of:

cooling the liquid phase comprising the stabilized hydrocarbon condensate being discharged from the bottom end of the stabilizer column whereby discharging heat from the liquid phase thereby becoming a cooled stream comprising the stabilized hydrocarbon condensate;

splitting the cooled stream comprising the stabilized hydrocarbon condensate into a recycle stream and a discharge stream;

passing the discharge stream to a condensate storage tank;

pumping the recycle stream up to above the first vapour/liquid contacting device and below the first inlet location; and feeding the recycle stream back into the stabilizer column at a level above the first vapour/liquid contacting device and below the first inlet location and at a first flow rate of the stabilizer column.

10. The method of claim 9, further comprising:

determining a second flow rate of the stabilizer column, said second flow rate comprising a flow rate of the pressurized liquid hydrocarbon feed stream being discharged from the inlet separator;

adjusting the first flow rate whereby the sum of the first flow rate and the second flow rate exceeds a predetermined minimum liquid feed rate into the stabilizer column.

11. The method of claim 1, wherein said step of compressing the vapour phase being discharged from the top end of the stabilizer column to an auxiliary pressure comprises passing the vapour phase though an overhead compressor system comprising a plurality of overhead compressors, whereby prior to passing the vapour phase dividing the vapour phase being discharged from the top end of the stabilizer column into two or more part streams and passing each of the part streams through one of the overhead compressors whereby at least one overhead compressor is provided per part stream and whereby an equal number of compressed overhead vapour part streams is provided at the auxiliary pressure as there are part streams.

12. The method of claim 11, wherein each of the compressed overhead vapour part streams are de-superheated by passing each of the compressed overhead vapour part streams through a de-superheater heat exchanger whereby at least one de-superheater heat exchanger is provided per compressed overhead vapour part stream, and then all of the compressed overhead vapour part streams are recombined to form the compressed overhead vapour stream that is passed through the heat exchanger of claim 1.

13. The method of claim 1, wherein the step of providing the pressurized unstabilized hydrocarbon condensate stream at said first temperature comprises:

providing a pressurized natural gas feed stream, said pressurized natural gas feed stream comprising a component selected from the group consisting of methane, ethane, propane, butanes, $C_5$+ components, one or more volatile inert components, and any combination thereof, whereby at least 80 mol % is methane;

partially condensing said pressurized natural gas feed stream, whereby condensing at least the $C_5$+ components, thereby creating a partially condensed natural gas stream;

passing the partially condensed natural gas stream through a liquids extraction device and extracting the pressurized unstabilized hydrocarbon condensate stream from the refrigerated natural gas stream, said pressurized unstabilized hydrocarbon condensate stream comprising at least the condensed $C_5$+ components.

14. The method of claim 13, further comprising discharging a lean natural gas stream from the liquids extraction device simultaneously with the pressurized unstabilized hydrocarbon condensate stream, further refrigerating the lean natural gas stream for fully condensing the lean natural gas stream, and subsequently depressurizing the lean natural gas stream to produce a flash vapour stream and a liquefied natural gas stream.

15. The method of claim 14, wherein said partially evaporating the pressurized unstabilized hydrocarbon condensate stream comprises indirectly heat exchanging the pressurized unstabilized hydrocarbon condensate stream in a feed-effluent heat exchanger against an effluent stream being fed to the feed-effluent heat exchanger at the second temperature, wherein the effluent stream at said second temperature consists of one or both of the vapour effluent stream and the liquid effluent stream and wherein the effluent stream being discharged from the feed-effluent heat exchanger is recombined with the lean natural gas stream, prior to said further refrigerating.

16. The method of claim 3, wherein the effluent stream at said second temperature comprises the vapour effluent stream.

17. The method of claim 16 further comprising:

passing the vapour effluent stream being discharged from the overhead separator to the feed-effluent heat exchanger.

* * * * *